US005845899A

United States Patent [19]

Satoh et al.

[11] Patent Number: 5,845,899

[45] Date of Patent: Dec. 8, 1998

[54] CASSETTE WITHDRAWING MECHANISM FOR USE WITH AN IMAGE FORMING APPARATUS

[75] Inventors: Satoshi Satoh; Masahiro Watashi; Hideo Fukuda, all of Osaka, Japan

[73] Assignee: Mita Industrial Co., Ltd., Osaka-fu, Japan

[21] Appl. No.: 775,118

[22] Filed: Dec. 30, 1996

[30] Foreign Application Priority Data

Jan. 10, 1996 [JP] Japan ..... 8-002465

[51] Int. Cl.[6] ..... B65H 3/44

[52] U.S. Cl. ..... 271/9.11; 271/162

[58] Field of Search ..... 271/9.01, 9.11, 271/162, 164

[56] References Cited

U.S. PATENT DOCUMENTS 3,977,666 8/1976 Suzuki et al. ..... 271/9.11
3,989,236 11/1976 Komori et al. ..... 271/9.01
5,158,276 10/1992 Toma ..... 271/9.11

FOREIGN PATENT DOCUMENTS 402 178 121 7/1990 Japan ..... 271/9.11
403 013 427 1/1991 Japan ..... 271/9.11

*Primary Examiner*—H. Grant Skaggs
*Attorney, Agent, or Firm*—Jordan and Hamburg

[57] ABSTRACT

A simultaneous cassette withdrawal restriction mechanism for use with an image forming apparatus provided with a plurality of cassettes includes a projection provided on each cassette; a connecting rod; and an engageable member which is adapted for engaging with the corresponding projection, the connecting rod is integrally formed with the engageable members. The engageable member is selectively changeable with its posture between a first posture to restrict the withdrawal movements of the cassettes other than one which had been already withdrawn out of a main body of the image forming apparatus and a second posture to allow one of the cassettes to be withdrawn once the one having been withdrawn is returned to the main body of the image forming apparatus.

7 Claims, 9 Drawing Sheets

CASSETTE WITHDRAWING MECHANISM FOR USE WITH AN IMAGE FORMING APPARATUS

BACKGROUND OF THE INVENTION

This invention relates to a cassette withdrawing mechanism, and more particularly to a mechanism of restricting simultaneous withdrawal of cassettes of multi-stage type (in which a plurality of cassettes are arranged vertically one over another) for use with an image forming apparatus such as copying machine, printer, and facsimile machine.

An image forming apparatus has an imaging assembly provided with a photosensitive drum which is rotated at a constant speed and is operated in such a manner that a document image formed on a surface of the photosensitive drum is transferred onto a copying sheet and fixed thereon to conduct an image formation on the copying sheet. Specifically, after being charged uniformly, the surface of the photosensitive drum is exposed to a light image to form an electrostatic latent image. Toner is electrically attracted to the electrostatic latent image to develop the latent image into a toner image. The thus formed toner image is transferred onto a copying sheet being dispensed one by one from one of the cassettes of multi-stage type.

The image forming apparatus is internally equipped with the plurality of cassettes which are vertically arranged one over another stage-wise (cassettes of multi-stage type) and are withdrawable from a main body of the image forming apparatus. Each cassette contains copying sheets of a specified size different from each other. Upon designation of a specified copy size, copying sheets of the specified size are dispensed one by one from the corresponding cassette to transfer a toner image onto the copying sheet.

The image forming apparatus incorporated with the cassettes of conventional multi-stage type has suffered the following problems. In the image forming apparatus equipped with the conventional multi-stage type cassettes, the plurality of cassettes are withdrawable from the apparatus main body simultaneously. Accordingly, there may occur a case that the plurality of cassettes are kept in a drawn state, which in turn imbalances the image forming apparatus as a center of gravity of the image forming apparatus as a whole will be shifted to a forward. How unstable the image forming apparatus is going to be when the all the cassettes are withdrawn solely depends upon a weight ratio of the whole cassettes to the image forming apparatus in its entirety or the slope of the floor. As a result, inadvertently placing a little weight onto the withdrawn cassette, for instance putting a hand on the cassette, would increase a possibility of tilt of the image forming apparatus.

SUMMARY OF THE INVENTION

It is therefore an object of the invention to overcome the aforementioned drawbacks in the conventional technology and to provide a simultaneous cassette withdrawal restriction mechanism for use with an image forming apparatus provided with a plurality of cassettes comprising: a projection provided on each cassette; a connecting rod; and an engageable member which is adapted for engaging with the corresponding projection, the connecting rod is integrally formed with the engageable members, the engageable member being selectively changeable its posture between a first posture to restrict the withdrawal movements of the cassettes when one of the cassettes had been already withdrawn out of the main body and a second posture to allow one of the cassettes to be withdrawn when the one having been withdrawn is returned to the main body of the image forming apparatus.

With this arrangement, when the one of the cassettes is withdrawn from the main body, then all the rest of the cassettes are kept in the main body. Thus only the weight of one cassette contributes a shift of the center of gravity of the image forming apparatus to a front and it prevents a likelihood that the image forming apparatus is tilted to a forward. This would in turn secure the stableness of the image forming apparatus.

Preferably, the connecting rod and the engageable members are all integrally formed and rotatable into a first direction and a second direction, opposite to the first direction, about a rotational axis of the connecting rod and the engageable member and corresponding projection are set such that the engageable member in the first posture is prohibited from rotating into the first direction and allowed to rotate into the second direction and the engageable member in the second posture is allowed to rotate into the first direction upon making a contact with the projection of one of the cassettes.

It may also be preferable that the apparatus further comprises a biasing member for biasing the engageable member into either a first direction or a second direction, opposite to the first direction, with respect to a neutral position of the biasing member.

With this arrangement, the engageable member is biased either into the first direction or the second direction. Thus it would secure the engageable member in either a cassette withdrawal restriction posture or a cassette withdrawable posture by the biasing force generated by the biasing member.

It may further be preferable that the engageable member in the first posture is biased into the first direction and the engageable member in the second posture is biased into the second direction.

One aspect of this invention that the biasing member may be a toggle spring.

With this feature, the biasing member can be easily constructed by a ordinary coil spring. Thus it would suppress the cost increase for the biasing member.

In another aspect of this invention, the engageable member may be formed with a recess and the projection of the cassette is slidably engaged along the recess to rotate the engageable member into the first direction when the one of the cassette is withdrawn from the main body of the image forming apparatus and the projection is slidably engaged along the recess to rotate the engageable member into the second direction when the one of the cassette having been withdrawn is restored into the main body of the image forming apparatus.

With this arrangement, the contact between the engageable member and the projection is securely carried out.

In yet another aspect of this invention, it is appreciated that the connecting rod is provided in a front region of the main body of the image forming apparatus.

With this arrangement, since the connecting rod is situated in a frontal region of the apparatus, it would avoid the necessity of some of the interconnecting member which would be required in case that the connecting rod is situated in a rearward of the apparatus. When the connecting rod is situated in the rearward region of the apparatus, the distance between the projection provided on the side of the cassette in a drawn state and the engageable member integrally provided on the connecting rod is enlarged thus it requires some interconnecting member to link a motion of the cassette and the engageable member.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
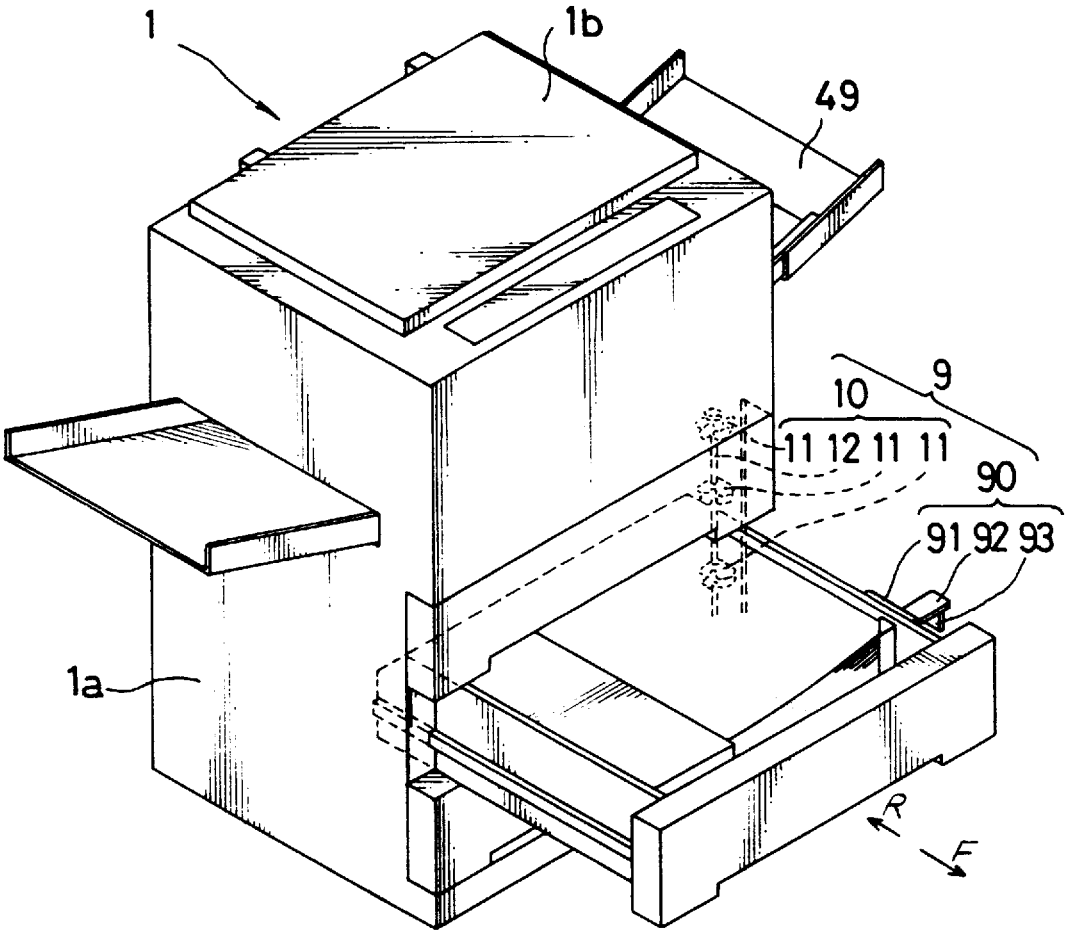
FIG. 1 is an overall perspective view showing a copying machine incorporated with a cassette withdrawing mechanism as a first embodiment according to the present invention.
Figure 2:
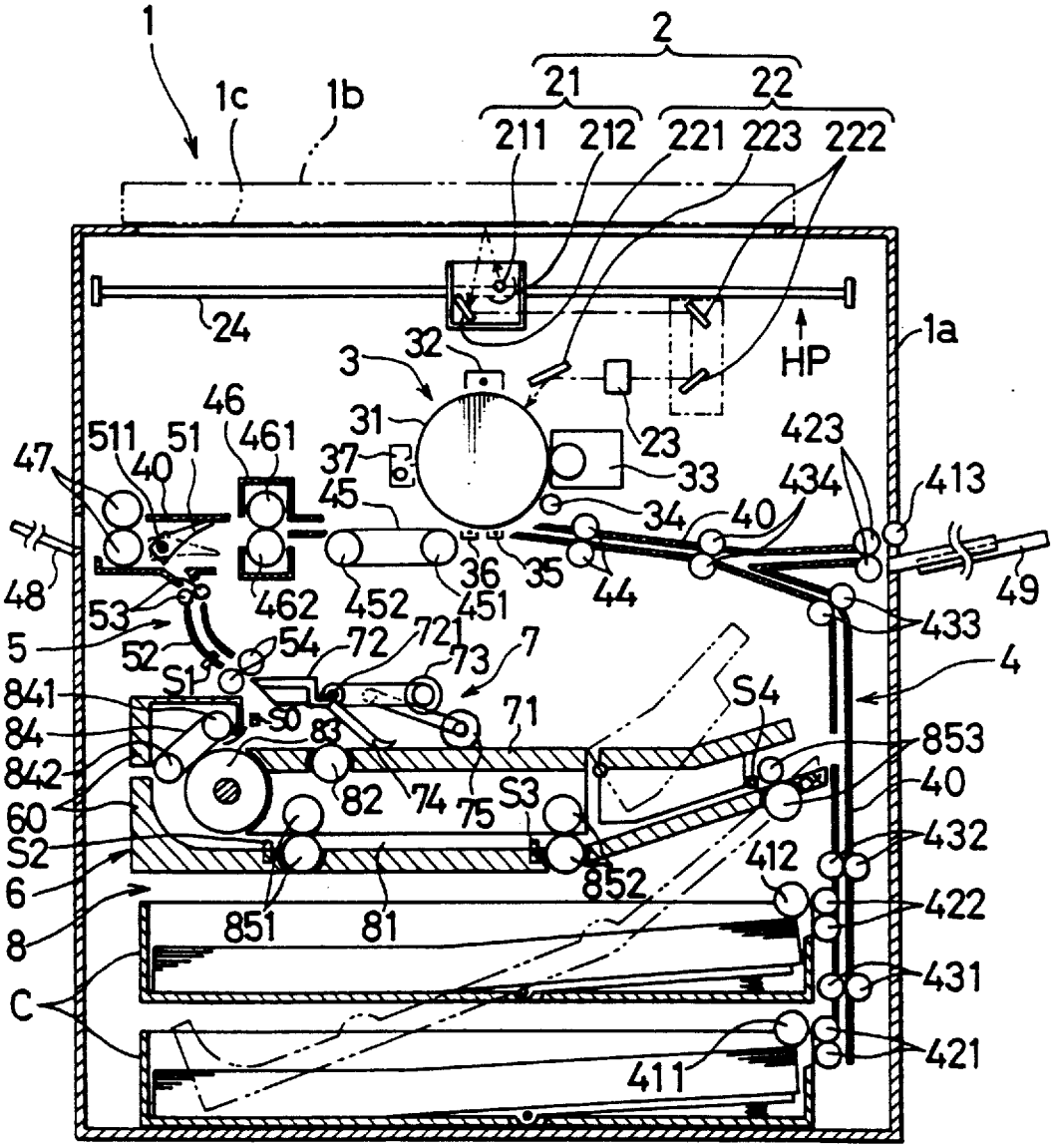
FIG. 2 is a diagram showing an internal arrangement of the copying machine.

Preferred embodiments of the present invention are described with reference to the accompanying drawings. FIG. 1 is an overall perspective view showing a copying machine incorporated with a cassette withdrawing mechanism according to the present invention. FIG. 2 is a diagram showing an internal arrangement of the copying machine.

Indicated at 1 is the copying machine. The copying machine 1 comprises a copying machine main body 1*a* and a document placement portion 1*b* arranged on top of the main body 1*a*. The main body 1*a* comprises an optical assembly 2, an imaging assembly 3 including a photosensitive drum 31, a sheet transport mechanism 4, a sheet inverting mechanism 5, and a duplex copying unit 6.

The document placement portion 1*b* includes a contact glass 1*c* and a document presser. When a document is manually placed on the contact glass 1*c* mounted at the top of the copying machine main body 1*a* and the document presser covers the contact glass 1*c*, the document is securely placed between the contact glass 1*c* and the document presser. Alternatively, the document placement portion 1*b* may be provided with an automatic document feeder arranged on an upper portion of the contact glass 1*c*. With such automatic document feeder, documents stacked on the document feeder are automatically fed one after another onto a specified exposure position of the contact glass 1*c* where a document image is read, and are discharged one after another after the image reading.

The optical assembly 2 comprises a first optical portion 21, second optical portion 22, a focus lens 23, a pair of guide rails 24, 24, and an unillustrated optical assembly drive mechanism. The first optical portion 21 includes a light source 211 such as a halogen lamp which reciprocally scans a document image placed on the contact glass 1*c* within a predetermined area from a home position HP (document reference position) and to a specified position, and a reflected mirror 212. The second optical portion 22 includes a plurality of reflected mirrors, such as mirrors 221 and 222 both of which introduce a light image of the document image projected by light emitted from the light source 211 to the imaging assembly 3. The lens 23 is adapted for focusing the light image onto the surface of the photosensitive drum 31 The guide rails 24, 24 are adapted for reciprocally moving the first and second optical portions 21, 22 in sideways directions of FIG. 2. The optical assembly drive mechanism is adapted for driving the first and second optical portions 21 and 22 at respective specified speeds along the guide rails 24, 24. A reflected mirror 223 introduces the light image passing through the lens 23 to a specified exposure position on the photosensitive drum surface at which the light image is to be exposed.

As mentioned above, light emitted from the light source 211 is projected to an image of a document placed on the contact glass 1*c* to obtain a light image. The light image is reflected by the reflected mirrors 212, 221, and 222, as shown by the broken line in FIG. 2, and via the lens 23 is guided to the specified exposure position on the drum surface by way of the reflected mirror 223.

The imaging assembly 3 includes a photosensitive drum 31 which is rotated in the clockwise direction at a constant speed by an unillustrated drum drive mechanism. The imaging assembly further comprises a main charger 32, developing unit 33, toner recovery portion 34, transfer portion 35, separation portion 36, and cleaning unit 37 in a periphery of the photosensitive drum 31 in the rotating direction thereof in this order. After being uniformly charged by the main charger 32, the surface of the photosensitive drum 31 is exposed to a light image to form an electrostatic latent image thereon. Toner supplied from the developing unit 33 is electrically attracted to the latent image to develop the latent image into a toner image. Subsequently, the toner image is transferred onto a copy sheet by the transfer portion 35. Then, the copy sheet carrying the toner image is separated from the surface of the photosensitive drum 31 by the separation portion 36 and transported to a fixing portion 46.

The sheet transport mechanism 4 includes a plurality of cassettes C, C each of which is detachably mounted to a lower portion of the copying machine main body 1*a* and are arranged vertically stage-wise one over another (mounted in multi-stage). It should be appreciated that the cassettes are withdrawable in the F direction and retractable in the R direction in the drawings (see FIG. 1). Each cassette is adapted for containing copy sheets of a specified size in a stacked state therein.

The sheet transport mechanism 4 further comprises feed rollers 411, 412 for feeding a copy sheet in the cassette one by one from an upstream side of the sheet transport direction, separation roller pairs 421, 422 for preventing a multi-feed of copy sheets, transport roller pairs 431 to 434, and a registration roller pair 44 for transporting the copy sheet being fed in timed relation with an image formation.

The sheet transport mechanism 4 further comprises a transport belt 45 which is stretched around belt rollers 451 and 452, fixing portion 46, sheet discharge roller pair 47, and sheet discharge tray 48. A sheet guide portion 40 is adapted for guiding a copy sheet transported by the separation roller pairs 421, 422 toward the sheet discharge roller pair 47, and comprises plate members disposed in parallel to each other spaced apart by a specified distance. A manual insertion tray 49 is adapted for manually placing copy sheets of a specified size thereon. The manual insertion tray 49 includes a feed roller 413 and separation roller pair 423. A copy sheet fed inside the copying machine main body 1*a* through the manual insertion tray 49 is transported toward the sheet discharge roller pair 47 along the sheet guide portion 40.

The fixing portion 46 includes a heater roller 461 and a presser roller 462. The heater roller 461 is internally provided with a heater, while the presser roller 462 is pressed against the heater roller 461 at a certain pressure.

A copy sheet dispensed from one of the cassettes C or inserted through the manual insertion tray 49 by one of the feed rollers 411 to 413 is fed to the registration roller pair 44 via one of the transport roller pairs 431 to 434. Then, the copy sheet is transported in timed relation with a timing of exposure and scanning by the optical mechanism 2 to transfer a toner image formed on the surface of the photosensitive drum 31 onto the copy sheet by the transfer portion 35. The copy sheet carrying the toner image is transported to the fixing portion 46 by way of the transport belt 45, where the toner image is fixed on the copy sheet, and discharged to the sheet discharge tray 48 by the sheet discharge roller pair 47.

The sheet inverting mechanism 5 is arranged on the way of the sheet guide portion 40 between the fixing portion 46 and sheet discharge roller pair 47. The sheet inverting mechanism 5 includes a switching member 51 which is pivotally rotated about a pivot 511 by an unillustrated electromagnetic solenoid to switchably direct the copy sheet being transported to the sheet guide portion 40 toward the sheet discharge roller pair 47 (to thereby enable single-sided copying) and toward the duplex copy unit (to thereby enable double-sided copying).

The sheet inverting mechanism 5 further comprises a sheet inverting guide 52, sheet transport roller pair 53 disposed at an upstream end of the sheet inverting guide 52, and sheet discharge roller pair 54 disposed at a downstream end of the sheet inverting guide 52. The sheet inverting guide 52 includes curved guide plates opposingly disposed to each other spaced apart by a specified distance to guide a copy sheet toward the duplex copy unit 6 therebetween.

With this arrangement, a copy sheet whose transport direction is switched toward the duplex copy unit 6 is transported downstream along the sheet inverting guide 52, while having a warp of the copy sheet which is caused at the fixing portion 46 corrected. Thereby, the copy sheet is guided to the sheet discharge roller pair 54 in a flat state as much as possible.

The duplex copy unit 6 is adapted for performing double-sided copying, and includes a unit main body 60. The duplex copy unit 6 comprises an intermediate tray unit 7 and a refeeding mechanism 8. Specifically, the intermediate tray unit 7 includes an intermediate tray 71 on which copy sheets being transported to the duplex copy unit 6 are to be stacked, a sheet presser 72, nip roller (drive roller) 73, guide member 74, and rotary member 75. The rotary member 75 falls onto the copy sheet by its weight and is rotated together with refeeding of the copy sheet. The guide member 74 is disposed on the left side of the guide roller 75 in FIG. 2. The guide member 74 has a slope slanting downward as approaching toward the rotary member 75. The guide member 74 is adapted for restraining copy sheets, which are being transported one after another and stacked on the intermediate tray 71, from being fed further forward (in FIG. 2, in the rightward direction) by being pressingly brought into contact with the copy sheets stacked on the intermediate tray 71 by its weight or with a small biasing force acting downward. The guide member 74 is supported at an upper end thereof. With this arrangement, the copy sheets are smoothly guided and stacked on the intermediate tray 71, thereby eliminating jammed state of copy sheet due to collision of a lead or trail end of the copy sheet in a feeding state against the rotary member 75.

The refeeding mechanism 8 is arranged below the intermediate tray 71, and has a refeed guide portion 81 comprising plate members opposingly disposed to each other spaced apart by a specified distance. The refeeding mechanism 8 further comprises a refeed roller 82, inverting roller 83, separation belt 84, and refeed roller pairs 851 to 853. The refeed roller 82 is disposed on the left side of the guide member 74 in FIG. 2 and has an upper circumferential portion exposed outside from the intermediate tray 71. The inverting roller 83 is arranged further on the left side of the refeed roller 82 in FIG. 2. The separation belt 84 is stretched between belt rollers 841 and 842, and is rotated in a direction opposite to the refeeding direction of copy sheet in contact state with a circumferential surface of the inverting roller 83. The refeed roller pairs 851 to 853 are arranged spaced apart from one another at an appropriate position of the refeed guide portion 81. At a nip position at which a copy sheet is to be nipped between the belt roller 841 and the inverting roller 83 is arranged a flexible sheet member 86 which droops downward from the unit main body 60. The sheet member 86 has a bottom end thereof coming into contact with the inverting roller 83.

The duplex copy unit 6 is detachably movable in front and rearward directions of the copying machine main body 1*a* in FIG. 2. Accordingly, in place of mounting the duplex copy unit 6 to the main body 1*a*, a new cassette C can be slidably inserted to the space corresponding to the duplex copy unit, thereby making it possible to provide first to third cassettes to the copying machine. In this case, it should be appreciated that a feed roller and separation roller pair of the new cassette (third cassette from the bottom) may be loaded prior to insertion of the third cassette.

How a copy sheet transported from the sheet discharge roller 54 is transported to the duplex copy unit 6 is described hereafter. When a copy sheet is transported to the intermediate tray 71 from the sheet discharge roller pair 54, the sheet presser 72 is rotated to temporarily press the copy sheet at a trail end thereof in the sheet transport direction (lead end of the copy sheet in the refeed direction) from above to eliminate the warp of the copy sheet, if any. After the copy sheets in a flat state are securely stacked on the intermediate tray 71, the nip roller 73 is rotated in such a direction as to refeed the copy sheets one by one so that the copy sheet is fed toward the nip position between the inverting roller 83 and the sheet member 86. Thereby, the copy sheet is securely nipped and a lead end thereof in the refeed direction is aligned. The refeed state of copy sheet is monitored by, e.g., an unillustrated rotary encoder provided at a rotary shaft of the guide roller 75. When refeeding of copy sheet to execute an image formation on the opposite side of the copy sheet is instructed, the refeed roller 82, inverting roller 83, and separation belt 84 are started to be driven.

Specifically, with the sheet presser 72 being rotated each time to press the copy sheets stacked on the intermediate tray 71 one by one from above, the copy sheets are dispensed (refed) one by one from the lowermost sheet. The copy sheet thus dispensed from the intermediate tray 71 is transported toward the sheet transport guide 40 in the right portion in FIG. 2 via the sheet guide portion 81. Then, the copy sheet is guided to the photosensitive drum 31 by the transport roller pair 433 and then registration roller pair 44. After having an image formed on the opposite side of the copy sheet, the copy sheet is discharged onto the sheet discharge tray 48 by the sheet discharge roller pair 47.

A cassette withdrawing mechanism according to the present invention is used with the copying machine having the above arrangement. When one of the cassettes C, C accommodated in the copying machine main body 1*a* is to be withdrawn, the cassette withdrawing mechanism 9 of the present invention restricts the other cassette(s) from being withdrawn out from the machine main body 1*a*.

Figure 3:
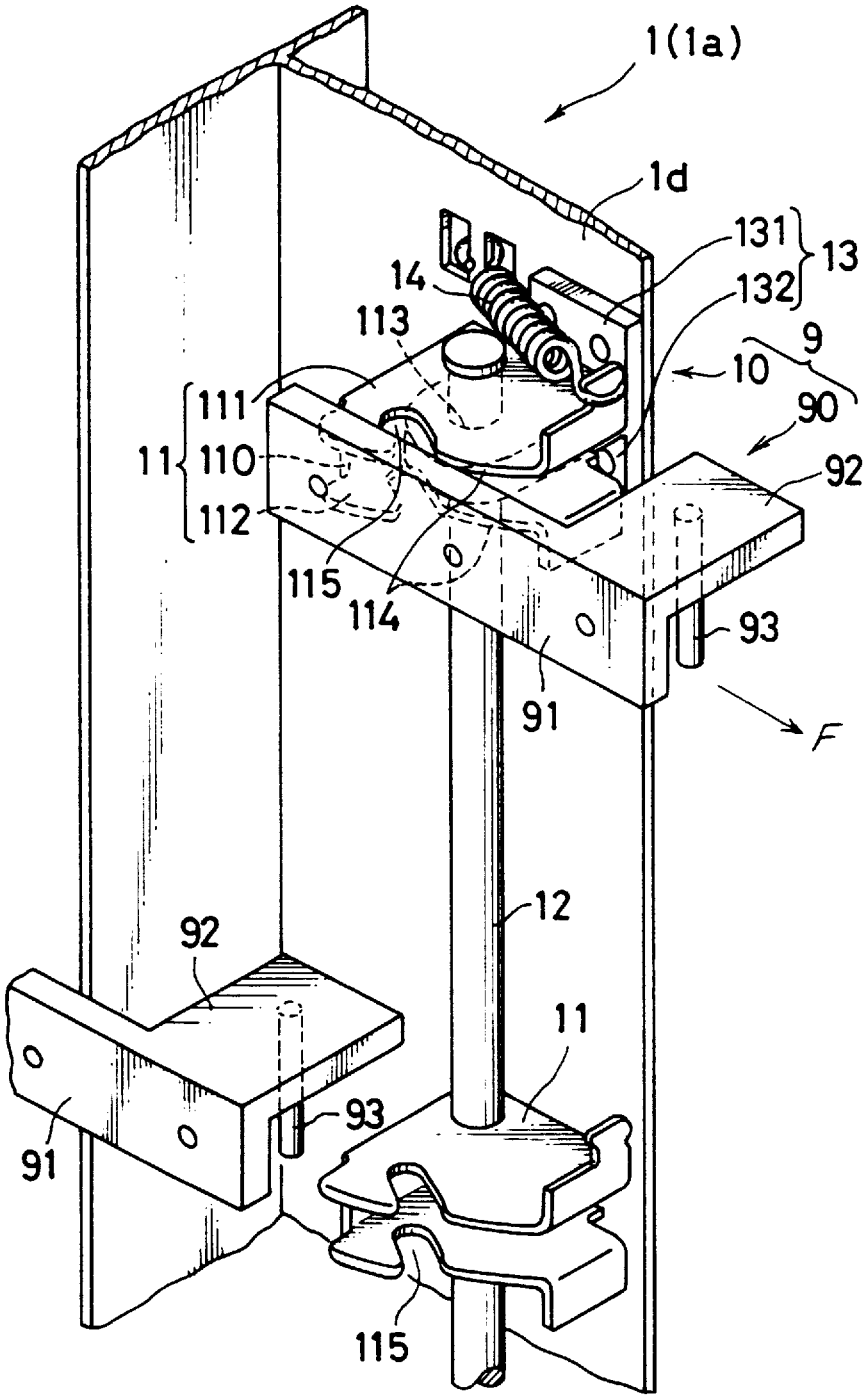
FIG. 3 is a partially enlarged perspective view of the cassette withdrawing mechanism when an arbitrary one cassette of the plurality of cassettes is being withdrawn.
Figure 4:
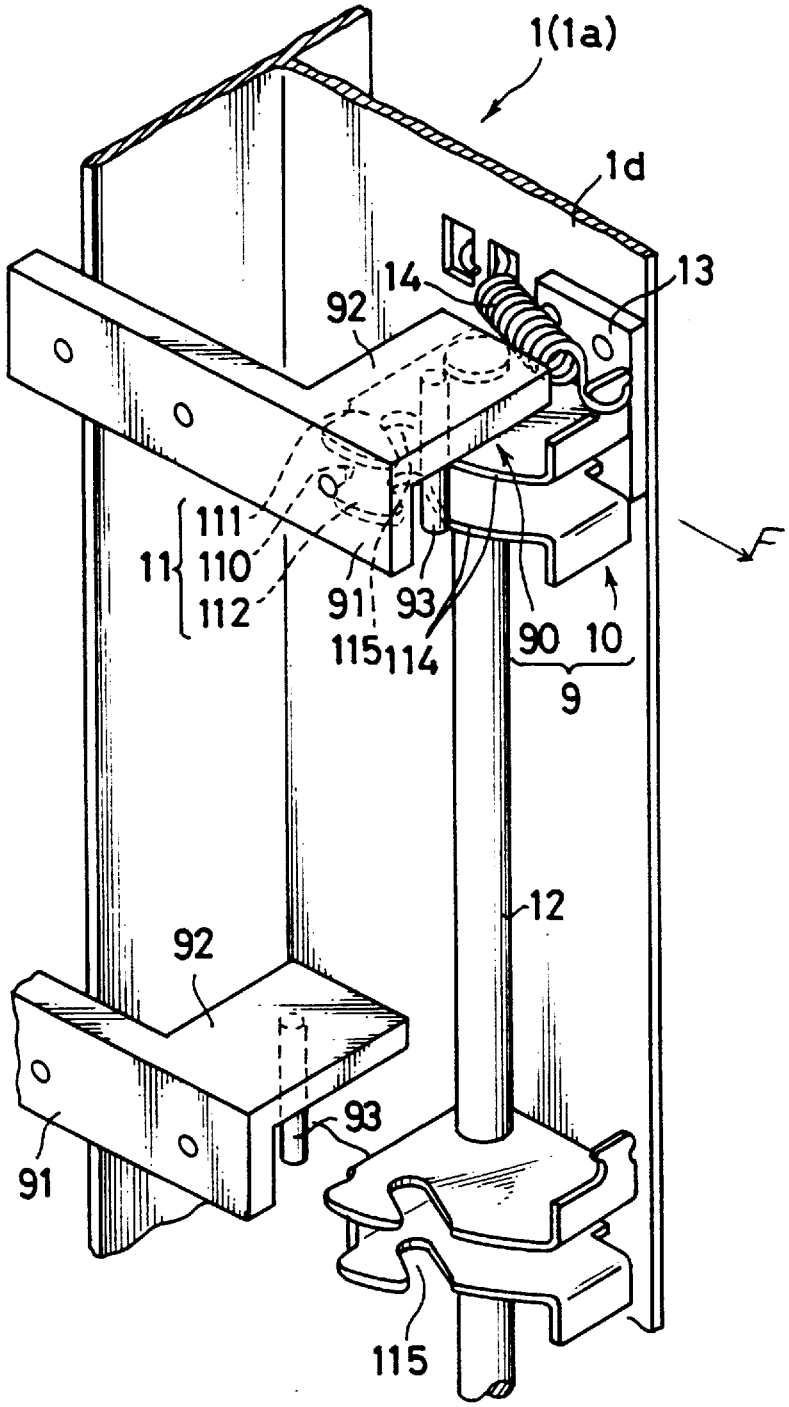
FIG. 4 is a partially enlarged perspective view of the cassette withdrawing mechanism when the once withdrawn cassette is being accommodated in a main body of the copying machine.
Figure 5:
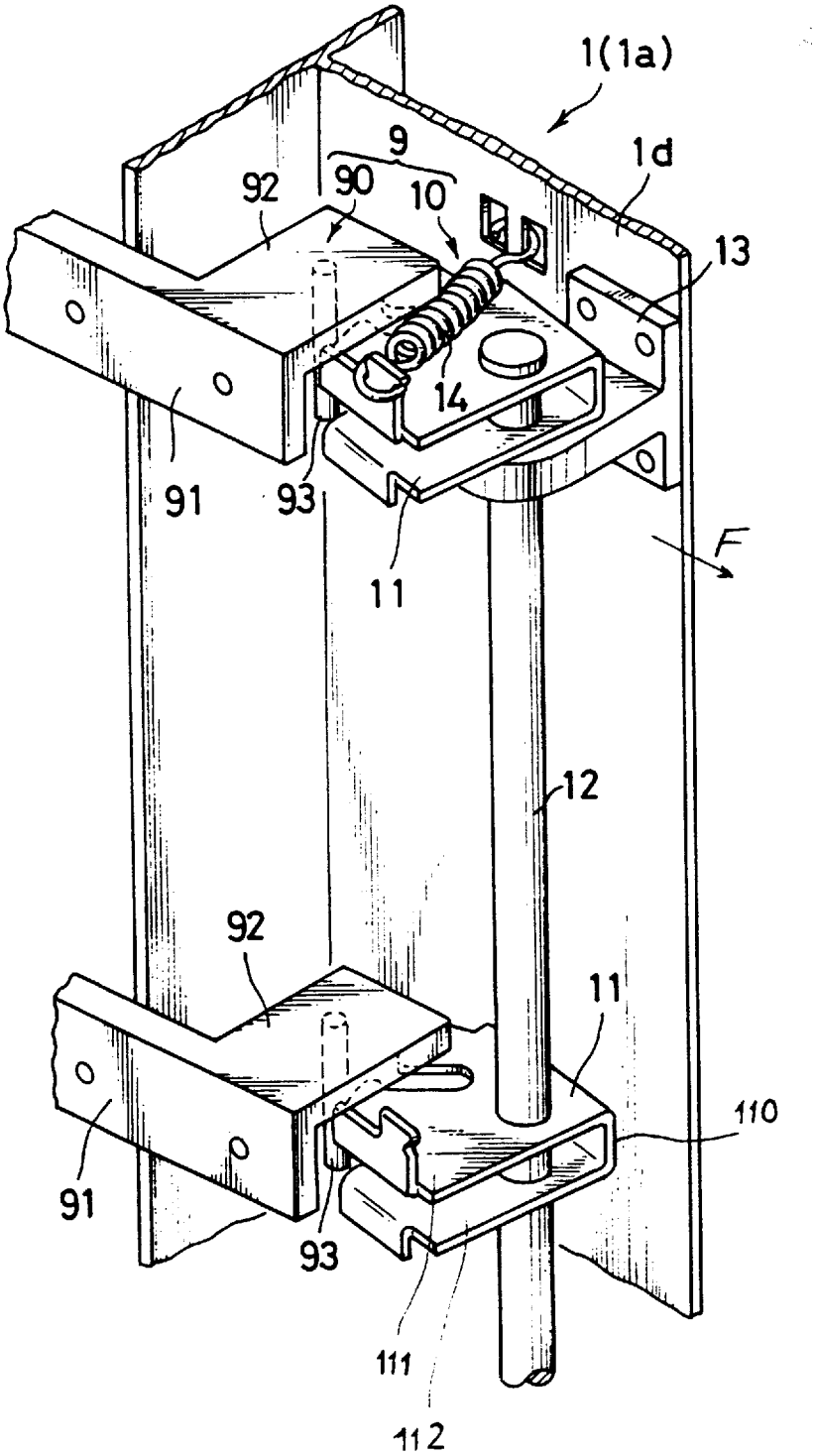
FIG. 5 is a partially enlarged perspective view of the cassette withdrawing mechanism when all the cassettes are accommodated in the main body of the copying machine.

FIGS. 3 to 5 are partially enlarged perspective views each showing the cassette withdrawing mechanism as a first embodiment of the present invention. FIG. 3 is a diagram showing a state of the cassette withdrawing mechanism when one of the cassettes C is being withdrawn. FIG. 4 is a diagram showing a state of the cassette withdrawing mechanism when the once withdrawn cassette is being accommodated in the copying machine main body 1*a*. FIG. 5 is a diagram showing a state of the cassette withdrawing mechanism when all the cassettes are accommodated in the machine main body 1*a*.

As shown in FIGS. 3 to 5, the cassette withdrawing mechanism 9 comprises an engaging member 90 and engageable mechanism 10. The engaging member 90 is projectingly provided on an outer side wall of each cassette C. The engageable mechanism 10 is provided on a side wall 1*d* which is formed on an inner side near the front portion of the copying machine main body 1*a* so as to be engageable with the corresponding engaging member 90.

The engaging member 90 is a bracket of an L-shape in plan view, and comprises a connecting portion 91, projected portion 92, and engaging pin 93. The connecting portion 91 is fixedly mounted to the side wall of each cassette C with screws or other fixing members. The projected portion 92 extends horizontally outward from an outer surface of the connecting portion 91. The engaging pin 93 has a cylindrical shape and extends vertically from a bottom of the projected portion 92.

The engageable mechanism 10, on the other hand, includes engageable members 11, a vertical rod 12, brackets 13 each provided at upper and lower portions of the side wall 1*d*, and a toggle spring (or a biasing member) 14. The engageable member 11 is arranged at a specified position inside the side wall 1*d* to be engageable with the corresponding engaging member 90. The engageable members 11 are associated with each other via the vertical rod 12. The brackets 13 are adapted for rotatably supporting the vertical rod 12 at upper and lower ends of the rod. The toggle spring 14 is used in applying biased forces to the engaging member 11 either in the R or F direction depending upon its relative position to a toggle line. The toggle mechanism is described later in more detail.

As shown in FIG. 5, the upper (lower) bracket 13 is made of a metal of T-shape in side view, although the lower bracket 13 is not shown in the drawings. Each bracket 13 includes a base 131 which is fixedly secured to the side wall 1*d* with bolts or other fixing members, and a support 132 horizontally inwardly projecting from an intermediate portion of the base 131. The support 132 is formed with a fitting hole substantially at the middle portion thereof to slidably insert the vertical rod 12. The vertical rod 12 is rotatable about its axis when fitted in the fitting holes of the supports 132 at its lower and upper ends.

The engageable member 11 is formed by bending a metal plate of a certain shape. Specifically, the engageable member 11 has an upper portion 111, lower portion 112, and bridging portion (vertical portion) 110. The upper portion 111 and lower portion 112 have the identical shape and oppose to each other relative to the vertical portion 110 to earn a greater rigidity.

The engageable member 11 is selectively brought to a withdrawal restriction posture where the other cassettes) is (are) prevented from being withdrawn out from the copying machine main body 1*a* when one of the cassettes is withdraw n, and a withdrawable posture where any one of the cassettes can be withdrawn from the machine main body 1*a* in a state that all the cassettes are accommodated in the machine main body 1*a*.

In the withdrawal restriction posture (see FIG. 3), the vertical portion 110 of each engageable member 11 opposes the rear of the copying machine main body 1*a*. Each engageable member 11 is formed with a through hole (pivot hole) 113 at an appropriate position on a corner thereof which is close to the vertical portion 110 and faces the side wall 1*d* in the withdrawal restriction posture in FIG. 3. In a state that the vertical rod 12 is fitted in the through holes 113, the vertical rod 12 and engageable members 11 are fixedly attached to each other by welding means and the like. Accordingly, when one of the engageable members 11 is rotated about the rotational axis of the vertical rod 12 which is rotatably supported by the brackets 13, the rest of the engageable members 11 are also rotated together about the rotational axis of the vertical rod 12.

Figure 9:
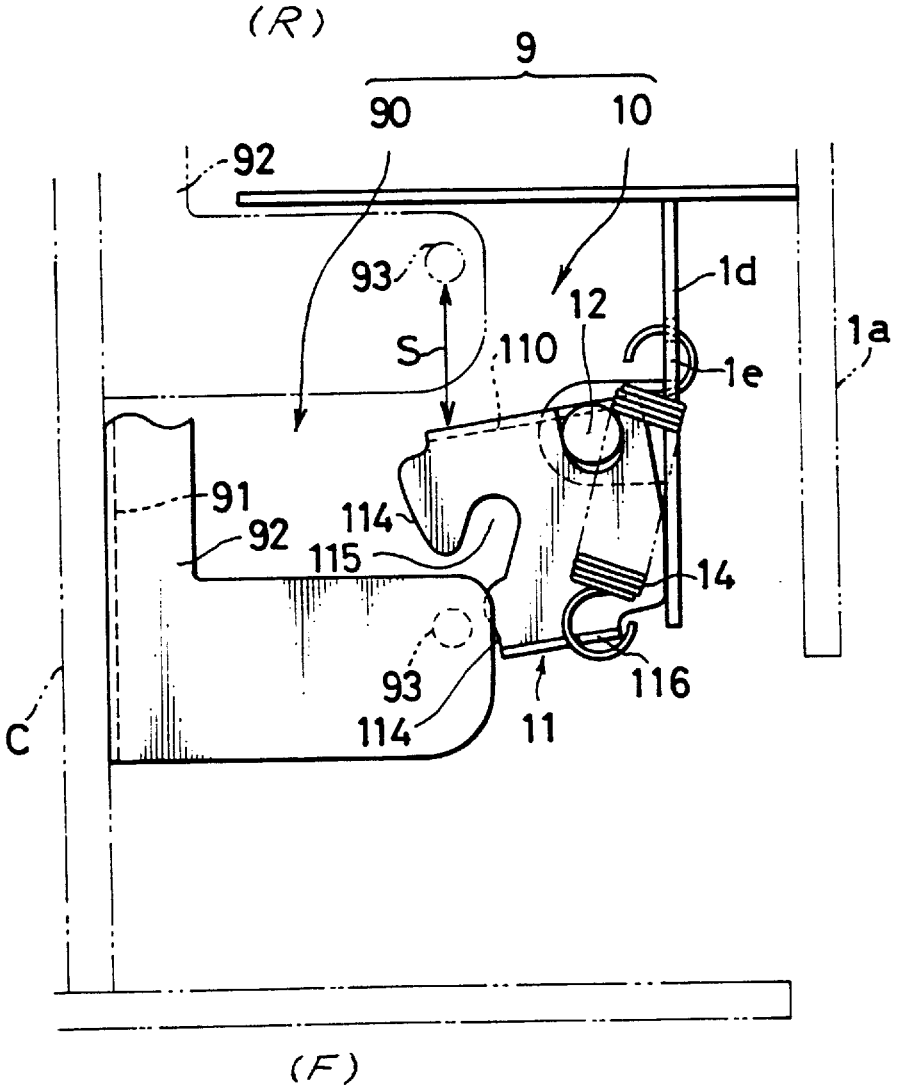
FIG. 9 is a plan view of the cassette withdrawing mechanism specifically showing that the cassette in FIG. 7 is further pulled out from the position shown in FIG. 8 and the engageable member is put to a withdrawal restriction posture where movement of the rest of the cassettes is locked.

Each engageable member 11 is further formed with a curved portion 114 at a position facing the side wall of the cassette C (engaging member 90) in the state shown in FIG. 3. The curved portion 114 has a greater area as approaching toward the vertical portion 110. The engageable member 11 is further formed with a U-shape recess 115 at a position close to the vertical portion 110. The recess 115 extends obliquely toward the vertical portion 110 from the end of curved portion 114. The recess 115 has such a shape that an inlet portion of the recess 115 opposes the engaging pin 93 of the engaging member 90 when the corresponding cassette is completely withdrawn out of the copying machine as shown in FIG.9.

More specifically, the shape of the recess 115 is such that when the cassette is started to be accommodated in the machine main body 1*a* by an external force such as an operator's action of pushing in the cassette, as shown in FIG. 4, the engaging pin 93 is slidably fitted in the recess 115. When the cassette is continued to be pushed with the external force, the engaging pin 93 in the fitted state rotates the corresponding engageable member 11 about the axis of vertical rod 12. Then, when the cassette is completely accommodated in the machine main body 1*a*, as shown in FIG. 5, the engaging pin 93 is slipped out of the recess 115, and the engageable member 11 is brought into a withdrawable posture.

The upper portion 111 of the engageable member 11 is bent upward at the opposite end of the vertical portion 110 to form an upright portion at which a spring washer 116 is to be mounted. The side wall 1*d* is further formed with a hole (spring support) 1*e* at a rear side of the mounting position of the bracket 13 to support the toggle spring. The toggle spring 14 is engaged between the spring support 1*e* and the spring washer 116.

The toggle spring 14 is stretchable to selectively bring the engageable member 11 to withdrawal restriction posture (shown in FIG. 3) and withdrawable posture (shown in FIG. 5). The spring support 1*e* is provided at the appropriate position so as to extend the spring 14 at the maximum length at a toggle position between the withdrawal restriction position and withdrawable position. The toggle position is described later in detail.

Figure 6:
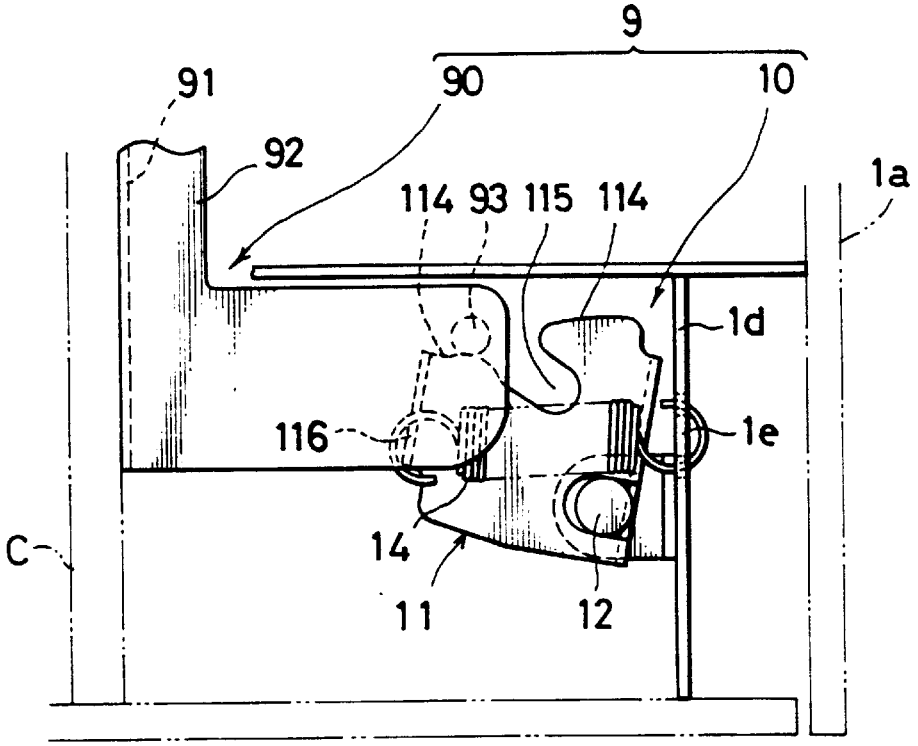
FIG. 6 is a plan view of the cassette withdrawing mechanism specifically showing an engageable member of the mechanism is put to a withdrawable posture where one of the cassettes is withdrawable in a state that all the cassettes are accommodated in the main body of the copying machine.
Figure 7:
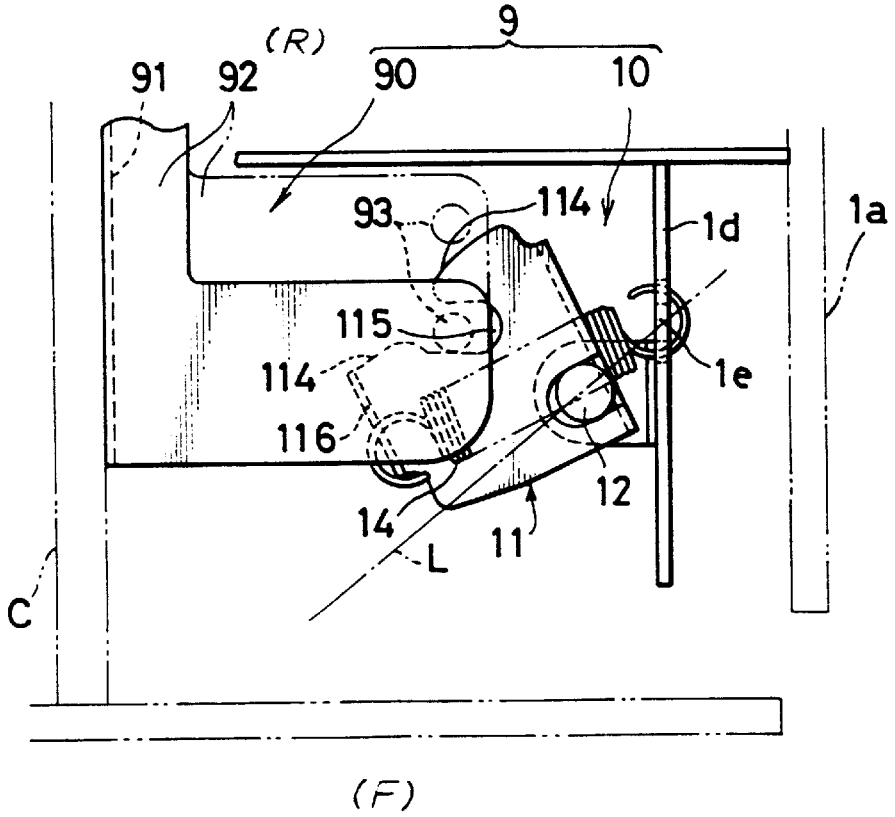
FIG. 7 is a plan view of the cassette withdrawing mechanism specifically showing that the engageable member is rotated by about 30° from the withdrawable posture by pulling out one of the cassettes from the main body of the copying machine.
Figure 8:
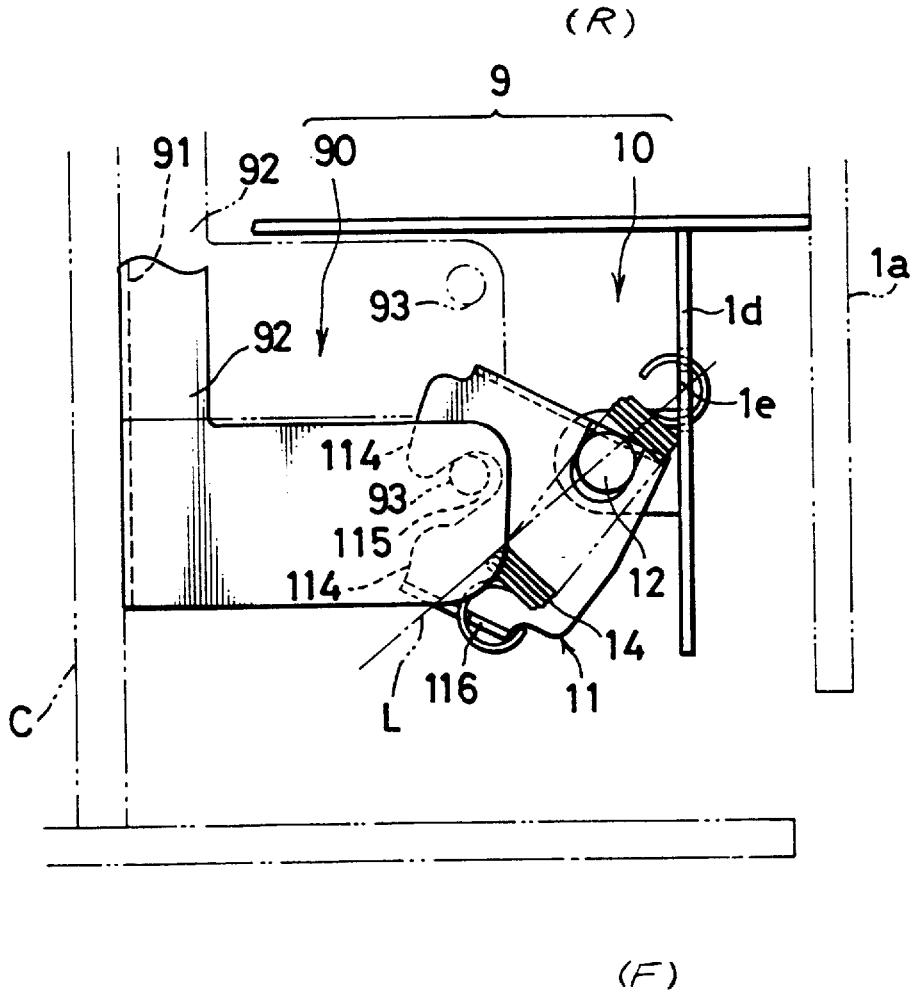
FIG. 8 is a plan view of the cassette withdrawing mechanism specifically showing that the engageable member is rotated by about 70° when the cassette in FIG. 7 is further pulled out.

FIGS. 6 to 9 are plan views each illustrating an operation of the cassette withdrawing mechanism 9. It should be appreciated that the cassettes are withdrawable in the F direction and retractable in the R direction in the drawings. FIG. 6 is a diagram showing a state that all the cassettes C are accommodated in the copying machine main body 1*a* and the engageable member 11 is brought to a withdrawable posture. FIG. 7 is a diagram showing a state that the engageable member 11 is rotated about 30° from the withdrawable posture by withdrawing one of the cassettes C from the machine main body 1*a*. FIG. 8 is a diagram showing a state that the engageable member 11 is rotated about 70° from the state of FIG. 6 by further withdrawing the cassette. FIG. 9 is a diagram showing a state that the cassette is completely withdrawn and the engageable member 11 is brought to a withdrawal restriction posture (hereinafter also referred to as a first posture).

First, as shown in FIG. 6 where all the cassettes C are accommodated in the copying machine main body 1*a*, i.e., all the engageble members 11 are in a withdrawable posture (hereinafter also referred to as a second posture), the engageable members 11 are biased in the clockwise direction about the axis of vertical rod 12 with a spring force exerted by the toggle spring 14. Thereby, the curved portion 114 is abutted against the engaging pin 93 of the engaging member 90.

When a particular one of cassettes is to be withdrawn from the state shown in FIG. 6, the curved portion 114 is rotated in the counterclockwise direction by the engaging pin 93. Thereby, the engageable member 11 is rotated in the counterclockwise direction about the axis of vertical rod 12 overcoming the biasing force acting into a clockwise direction by the toggle spring 14. As a result, as shown in FIG. 7, the engaging pin 93 is fitted in the recess 115 to rotate the engaging member 11 into a counterclockwise direction. At this stage, the toggle spring 14 is still being extended as the engaging member 11 further rotates into a counterclockwise direction up until the center axis of the toggle spring 14 coincides with a toggle line L. Up to crossing the toggle line L into the counterclockwise direction, the spring biases the engaging member 11 into a clockwise direction.

The toggle spring 14 is operated in the following manner. The biasing force of the spring 14 is canceled out when the toggle spring 14 is at a toggle position L, i.e., when the support point of the spring support 1*e*, rotational axis of the vertical rod 12 and support point of the spring washer 116 are aligned along the line L (hereinafter referred to as "toggle line"). Specifically, when the toggle spring 14 is aligned with the toggle line L (the center line of the toggle spring 14 coincides with the toggle line L), the engageable member 11 is not rotated either clockwise or counterclockwise direction and balanced in a stationary state.

The engageable member 11 is biased in the clockwise direction about the axis of vertical rod 12 until the toggle spring 14 coincides with the toggle line L. When the cassette is further pulled out with the external force, the rotating amount of the engageable member 11 is increased, and finally the spring 14 goes beyond the toggle line L, as shown in FIG. 8. When the toggle spring 14 rotates into a counterclockwise direction beyond the toggle line L, the engageable member 11, in turn, is applied with a biasing force acting in the counterclockwise direction about the axis of vertical rod 12 by the toggle spring 14. Accordingly, the engaging pin 93 is moved along the recess 115 in a direction toward the curved portion 114 to be escaped from the fitted state in the recess, as the cassette is further pulled out in the F direction.

As the cassette is further pulled out, as shown in FIG. 9, the engaging pin 93 is completely departed out of the recess 115, and a forward end corner of the engageable member 11 is abutted against the side wall 1d and maintained the posture by the biasing force of the toggle spring 14. Thereby, the engageable member 11 is kept from being rotated further in the counterclockwise direction, i.e., brought to a withdrawal restriction posture.

In summary, when one of the cassettes C is withdrawn out from the copying machine main body 1*a* to bring the corresponding engageable member 11 to a withdrawal restriction posture, the other engageable members 11 are also brought to the withdrawal restriction posture while the other cassette shown by the broken line in FIG. 9 remain in an accommodated state. In this state, the engaging pin 93 of the engaging member 90 of the cassette in the accommodated state is spaced apart from the vertical portion 110 of the corresponding engageable member 11 by the distance S. A letter "S" denotes an allowable distance for other cassettes to travel into either F or R direction.

In this state, when the external force is acted to pull out the other cassette in the accommodated state, the other cassette can be prevented from being withdrawn further in the F direction after being pulled out by the distance S because the engaging pin 93 of the engaging member 90 of the cassette is abutted against the vertical portion 110 of the corresponding engageable member 11 in the withdrawal restriction posture.

On the contrary, assuming the case where the once drawn cassette C were to be accommodated inside the machine main body 1*a*, as shown in FIG. 9, the external force is applied to the cassette C into the R direction so as to push the cassette into the machine main body la. Specifically, when the external force is applied to the cassette C, the engageable member 11 in the withdrawal restriction posture is rotated in the clockwise direction about the axis of vertical rod 12 with the engaging pin 93 fitted in the recess 115. Thereby, the engageable member 11 is returned to the withdrawable posture from the state in FIG. 9 to FIG. 8, to FIG. 7, and then finally to FIG. 6.

Figure 10:
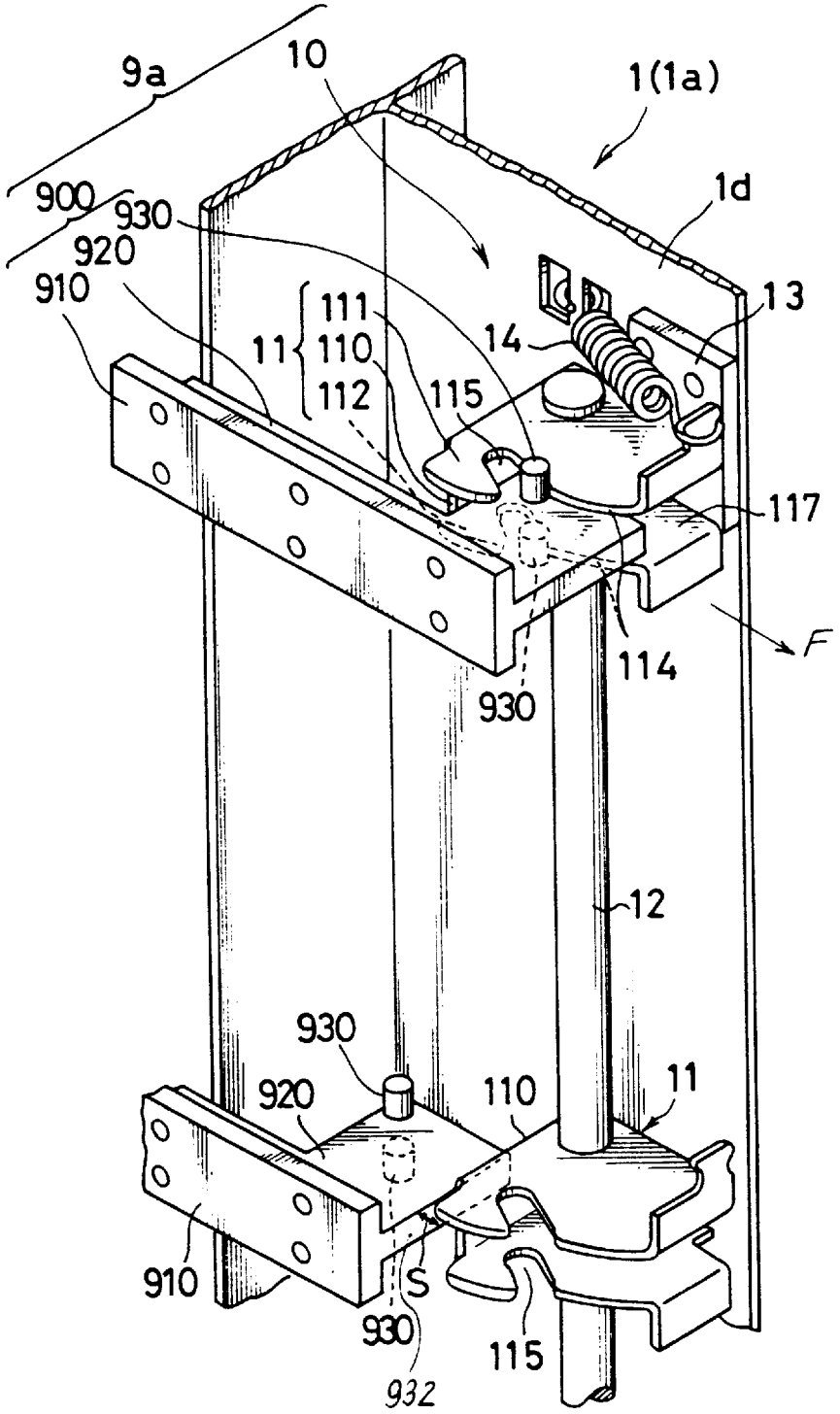
FIG. 10 is a partially enlarged perspective view of a cassette withdrawing mechanism as a second embodiment according to the present invention.

Next, a cassette withdrawing mechanism 9*a* as a second embodiment of the present invention is described with reference to FIG. 10. It should be appreciated that elements of the second embodiment identical to those of the first embodiment are denoted at the same reference numerals.

In the second embodiment, an engaging member 900 has a connecting portion 910, projected portion 920 which horizontally extends from an appropriate position of an outer surface of the connecting portion 910 toward the engageable member 11, and a pair of engaging pins 930 provided at upper and lower surfaces of the projected portion 920 at a rear end corner away from the connecting portion 910. The second embodiment is different from the first embodiment in the following points.

Specifically, the projected portion 920 has a thickness slightly smaller than a clearance 117 defined between the upper portion 111 and lower portion 112 so that the projected portion 920 slidably passes the clearance 117. Further, the projected portion 920 is provided at such a position that a lead end of the projected portion 920 is abutted against the vertical portion 110 of the corresponding engageable member 11 when a second one of the cassettes in an accommodated state is to be withdrawn while the first one of the cassettes has already been withdrawn out of the machine.

In the second embodiment, the pair of upright engaging pins 930 are provided. Alternatively, either one of the engaging pins 930, upper or lower one will do.

According to the arrangement of the second embodiment, when withdrawing or accommodating the cassette C from or in the machine main body 1*a*, the engaging pin 930 in a fitted state in the recess 115 rotates the engageable member 11 in the clockwise or counterclockwise direction to changeably bring the engageable member 11 in the withdrawal restriction posture or withdrawable posture, as the projected portion 920 passing the clearance 117 of the rotating engageable member 11 into F or R direction.

The second embodiment is advantageous in the following point. When one of the cassettes is in a withdrawn state, and hence all the engageable members 11 are in a withdrawal restriction posture, a lead end 932 of the engaging member 900 stays close to the vertical portion 110 of the corresponding engageable member 11 in the withdrawal restriction posture. It should be noted that the leading end 932 of the engaging member 900, not the engaging pin 93 as in the first embodiment, is used to abut against the rear end of the engageable member 11 in the first posture (the withdrawal restricting posture) for restricting the withdrawal movement of the cassettes. Accordingly, compared to the case of the first embodiment, the distance S of the second embodiment, the allowing travel of the cassettes in accommodated state, can be shortened. In other words, the distance S of the second embodiment can be set smaller than that of the first embodiment. Thereby, the movable range of the other cassette in an accommodated state is reduced when the other cassette is to be withdrawn with one cassette already brought to a withdrawn state.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A simultaneous cassette withdrawal restriction mechanism for use with an image forming apparatus provided with a plurality of cassettes comprising:

a projection provided on each cassette;

a connecting rod; and an engageable member which is adapted for engaging with the corresponding projection, the connecting rod being integrally formed with the engageable members, the engageable member being selectively changeable with its posture between a first posture to restrict the withdrawal movements of the cassettes when one of the cassettes had been already withdrawn out of a main body of the image forming apparatus and a second posture to allow one of the cassettes to be withdrawn when the one having been withdrawn is returned to the main body of the image forming apparatus.

2. A simultaneous cassette withdrawal restriction mechanism according to claim 1, wherein the connecting rod and the engageable members are all integrally formed and rotatable into a first direction and a second direction, opposite to the first direction, about a rotational axis of the connecting rod and the engageable member and corresponding projection are set such that the engageable member in the first posture is prohibited from rotating into the first direction and allowed to rotate into the second direction and the engageable member in the second posture is allowed to rotate into the first direction upon making a contact with the projection of one of the cassettes.

3. A simultaneous cassette withdrawal restriction mechanism according to claim 1, further comprising a biasing member for biasing the engageable member into either a first direction or a second direction, opposite to the first direction, with respect to a neutral position of the biasing member.

4. A simultaneous cassette withdrawal restriction mechanism according to claim 3, wherein the engageable member in the first posture is biased into the first direction and the engageable member in the second posture is biased into the second direction.

5. A simultaneous cassette withdrawal restriction mechanism according to claim 4, wherein the biasing member is a toggle spring.

6. A simultaneous cassette withdrawal restriction mechanism according to claim 5, wherein the engageable member is formed with a recess and the projection of the cassette is slidably engaged along the recess to rotate the engageable member into the first direction when the one of the cassette is withdrawn from the main body of the image forming apparatus and the projection is slidably engaged along the recess to rotate the engageable member into the second direction when the one of the cassette having been withdrawn is restored into the main body of the image forming apparatus.

7. A simultaneous cassette withdrawal restriction mechanism according to claim 1, wherein the connecting rod is provided in a front region of the main body of the image forming apparatus.

* * * * *